US009016557B2

(12) United States Patent
Wisecarver

(10) Patent No.: US 9,016,557 B2
(45) Date of Patent: Apr. 28, 2015

(54) SELF-LOCKING SUPPORT PANEL FOR CORRUGATED CONTAINER

(75) Inventor: Mark Wisecarver, Morristown, TN (US)

(73) Assignee: International Paper Company, Memphis, TN (US)

( * ) Notice: Subject to any disclaimer, the term of this patent is extended or adjusted under 35 U.S.C. 154(b) by 640 days.

(21) Appl. No.: 13/315,527

(22) Filed: Dec. 9, 2011

(65) Prior Publication Data

US 2013/0146651 A1 Jun. 13, 2013

(51) Int. Cl.
*B65D 5/44* (2006.01)

(52) U.S. Cl.
CPC ..... *B65D 5/445* (2013.01)

(58) Field of Classification Search
CPC ..... B65D 5/445
USPC ..... 229/122.32, 191, 199
See application file for complete search history.

(56) References Cited

U.S. PATENT DOCUMENTS

| | | | | | |
|---|---|---|---|---|---|
| 1,126,246 | A * | 1/1915 | Maier | 229/198 |
| 2,242,741 | A * | 5/1941 | Betts et al. | 229/122.33 |
| 2,310,408 | A * | 2/1943 | Ehrenfeld | 229/199 |
| 2,660,364 | A * | 11/1953 | Ferguson | 229/197 |
| 3,048,318 | A * | 8/1962 | Sabin | 229/120.38 |
| 3,918,630 | A * | 11/1975 | Meyers | 229/191 |
| 4,757,938 | A * | 7/1988 | Collins | 229/199 |
| 5,522,539 | A * | 6/1996 | Bazany | 229/199 |
| 2003/0094484 | A1 * | 5/2003 | Chu | 229/196 |
| 2007/0221721 | A1 * | 9/2007 | Bradford | 229/199 |
| 2011/0139863 | A1 * | 6/2011 | Babcock | 229/199 |

* cited by examiner

*Primary Examiner* — Gary Elkins
(74) *Attorney, Agent, or Firm* — Matthew M. Eslami

(57) ABSTRACT

A container comprises a body having a bottom wall, opposed side walls, and opposed end walls foldably joined with one another for holding and shipping different products contained therein. Each of the opposed side walls includes a respective first and second locking member. Two separate self-locking support panels each of which comprises a respective third and fourth locking members formed therein to be engaged with the corresponding first and second locking members in an overlapping relationship. Each of the first and second locking members is defined by a first locking tab and a first U-shaped slot that is formed by indentation of the first locking tab toward interior of the body of the container.

4 Claims, 13 Drawing Sheets

SELF-LOCKING SUPPORT PANEL FOR CORRUGATED CONTAINER

FIELD OF THE INVENTION

This invention relates generally to a shipping container constructed from a paperboard blank for holding a variety of articles and more particularly, to a shipping container having at least one separate support panel that significantly reduces bulging of the container.

BACKGROUND OF THE INVENTION

Numerous products are often packaged in large corrugated bulk containers. These products are generally small in size, packaged loosely, and are prone to shift around inside the container during transportation. The shifting of the products causes the sidewalls of the container to bulge; deforming the shape of the container and reducing the strength of the container to the point of failure. The bulging of the sidewalls deforms the container such that it is difficult to position the containers side by side in trucks and therefore reduces the number of containers that can be fit in a truck. Moreover, the bulging can also make it difficult to place the containers in racks and thus reducing storage space.

One approach to reduce or eliminate bulge in a container includes increasing the fiber contents of the container material or placing a corrugated liner around the perimeter of the container. However, increasing the fiber throughout a container is costly option and often will not solve the bulging problem. Another approach is adding a corrugated liner which is difficult to secure to the walls of the container and the size of the liner will often require the corrugation to be vertical where as horizontal corrugation offers the greatest flexural rigidity.

Therefore, it would be desirable to have a container that solves the aforementioned problems and can easily and inexpensively be produced using preexisting materials and processing equipment.

SUMMARY OF THE INVENTION

The present invention of shipping container has a self-locking support panel feature that permits for a section of the sidewall to fold down so that a user may gain access to the container during loading and unloading of the products in the container. It is noted that when the container contains flowable products, the flex pressure is greater toward the largest (weaker) sidewalls which is most commonly the length panels. The self-locking support panel provides an additional corrugated sidewall or panel, increasing the flexural rigidity in the weakest areas of the container. The self-locking feature eliminates the need for tape, staples, clips and/or the like. The corrugation direction of the self-locking support panel can be orientated to enhance increased flex or compression strength. The self-locking support panel can also be used onto adjacent sidewalls such as corners of the container to provide additional strength.

Other advantages of the present invention are that the self-locking support panel reduces or eliminates bulging by protecting the weak or affected areas of the container with less material offering a cost effective solution. The self-locking support panel is designed to cover only one sidewall or partial sidewall or multiple sidewalls or alternatively, to be used as self-locking corner post in the corners of a container. In addition, the self-locking support panel can be manufactured single wall, double wall, and triple wall maximizing its cost and performance effectiveness.

Accordingly, one aspect of the present invention is directed to a shipping container comprises a body having a bottom wall, opposed side walls, and opposed end walls foldably joined with one another for holding and shipping different products contained therein. Each of the opposed side walls includes a respective first and second locking member. Two separate self-locking support panels each of which comprises a respective third and fourth locking members formed therein to be engaged with the corresponding first and second locking members in an overlapping relationship. Each of the first and second locking members is defined by a first locking tab and a first U-shaped slot that is formed by indentation of the first locking tab toward interior of the body of the container.

Another aspect of the present invention is directed to a container comprises a body having a bottom wall, opposed side walls, and opposed end walls foldably joined with one another for holding and shipping different products contained therein. Each of the opposed end walls includes a respective first and second locking member and each of the opposed end walls includes an access door. Two separate self-locking support panels each of which having a respective third and fourth locking members is formed therein to be engaged with the corresponding first and second locking members in an overlapping relationship.

BRIEF DESCRIPTION OF THE DRAWINGS

A full understanding of the invention can be gained from the following description of the preferred embodiments when read in conjunction with the accompanying drawings in which.

DETAIL DESCRIPTION OF THE INVENTION

Figure 1:
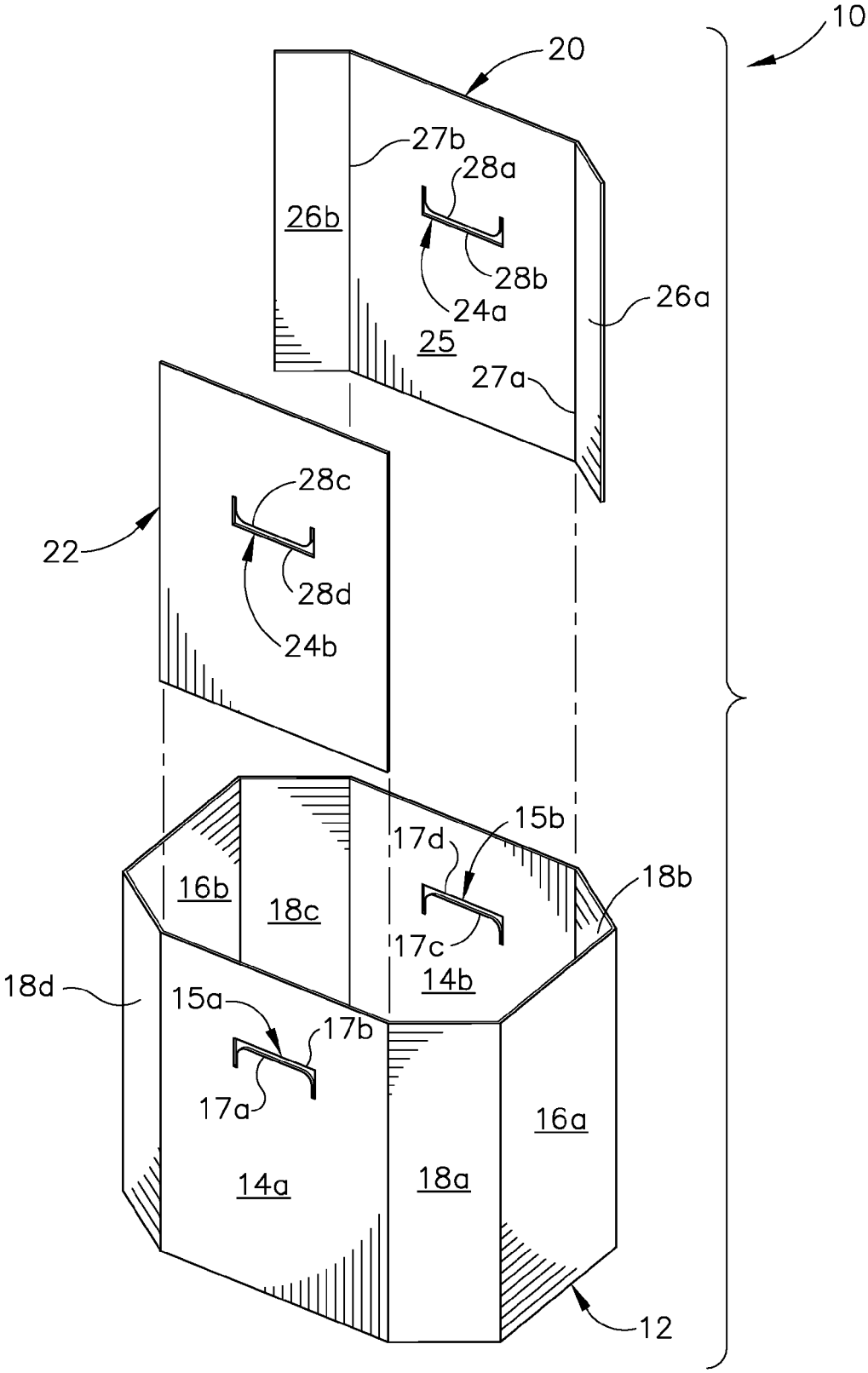
FIG. 1 is an exploded perspective view of a shipping container having two self-locking support panels in a spaced relationship in accordance to a first embodiment of the invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same or those elements are in the unfolded position.

FIG. 1 is an exploded perspective view of a shipping container 10 having a body 11 and two self-locking support panels 20, 22 in a spaced relationship in accordance to a first embodiment of the invention. The body 11 comprises a bottom wall 12, opposite parallel side walls 14*a*, 14*b*, opposite parallel end walls 16*a*, 16*b* and diagonal corner walls 18*a*, 18*b*, 18*c*, and 18*d* connecting the respective side walls 14*a*, 14*b* and respective end walls 16*a*, 16*b* at adjacent ends. Each of the respective side walls 14*a* 14*b* includes a respective first and second locking members 15*a* and 15*b* that are formed thereto above the central portion and they are substantially the same shape. The first locking member 15*a* includes a first locking tab 17*a* and a first U-shaped slot 17*b*. The first U-shaped slot 17*b* is formed by indentation of the first locking tab 17*a* toward the interior of the body 11. Similarly, the second locking member 15*b* includes a second locking tab 17*c* and a second U-shaped slot 17*d* which the second U-shaped slot 17*d* is formed by indentation of the second locking tab 17*c* toward the interior of the container 10.

Figure 2:
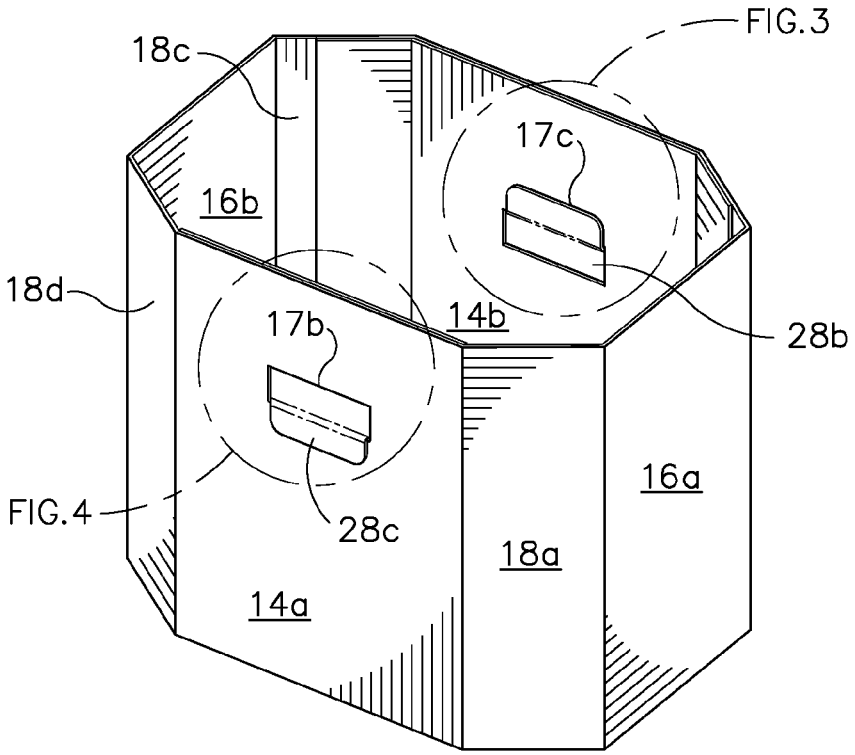
FIG. 2 is a perspective view of the shipping container shown in FIG. 1 with the two self-locking support panels in an operative position inside the container.
Figure 3:
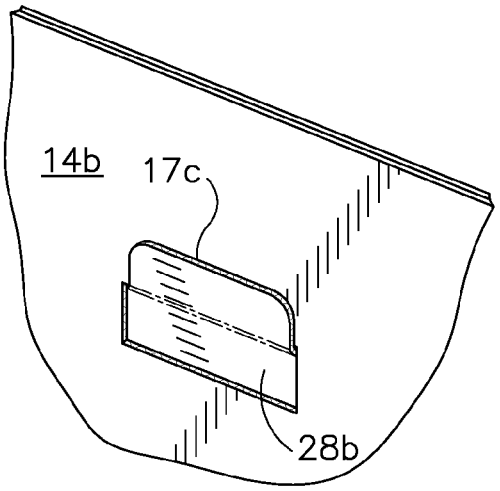
FIGS. 3 and 4 are fragmentary perspective views of the container in FIG. 2 illustrating the locking engagement of each of the self-locking support panels with the container.
Figure 4:
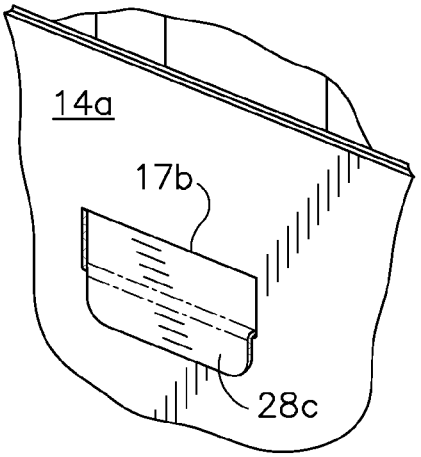

The two self-locking panels are defined by a first self-locking panel 20 and a second self-locking panel 22. The first self-locking panel 20 is defined by a central panel 25 and two diagonal panels 26*a*, 26*b* defined by fold lines 27*a*, 27*b*. When inserted into the body 11, the first self-locking panel 20 extends into the adjacent diagonal panels increasing performance in the corners by reducing potential splitting. It also increases top to bottom compression within the octagonal container. However, one of ordinary skill in the art knows that container with other geometry can be used as well. It should be noted that the first self-locking panel 20 is just a rectangularly-shaped panel without having any diagonal panels extending from its edge since it does not need it. The two diagonal panels 26*a*, 26*b* in the first self-locking panel 20 provide the extra strength required for the side wall 14*b* to sustain bulging since this side wall is more venerable for its size. The side walls 14*a* and 14*b* may have different length and width. Each of the respective first and second self-locking panels 20, 22 includes a respective third locking member 24*a* and a fourth locking member 24*b*. The third locking member 24*a* includes a third locking tab 28*a* and a third U-shaped slot 28*b*. The third U-shaped slot 28*b* is formed by indentation of the third locking tab 28*a* outward from the interior of the body 11 when it is engaged. Similarly, the fourth locking member 24*c* includes a fourth locking tab 28*c* and a fourth U-shaped slot 28*d* which the fourth U-shaped slot 28*d* is formed by indentation of the fourth locking tab 28*c* outward from the interior of the body 11 when it is engaged. The first and second locking members 15*a*, 15*b*, the third and fourth locking member 24*a*, 24*b* are substantially the same with one another. When the first and second self-locking panels 20, 22 are inserted into the inner sides of the respective side walls 14*a*, 14*b*, the respective first and second locking member 15*a*, 15*b* receives the corresponding third locking member 24*a* and a fourth locking member 24*b* such that the second locking tab 17*c* is engaged with the third U-shaped slot 28*b* and the fourth locking tab 28*c* is engaged with the first U-shaped slot 17*b* as seen best in FIGS. 2, 3, and 4.

Figure 5:
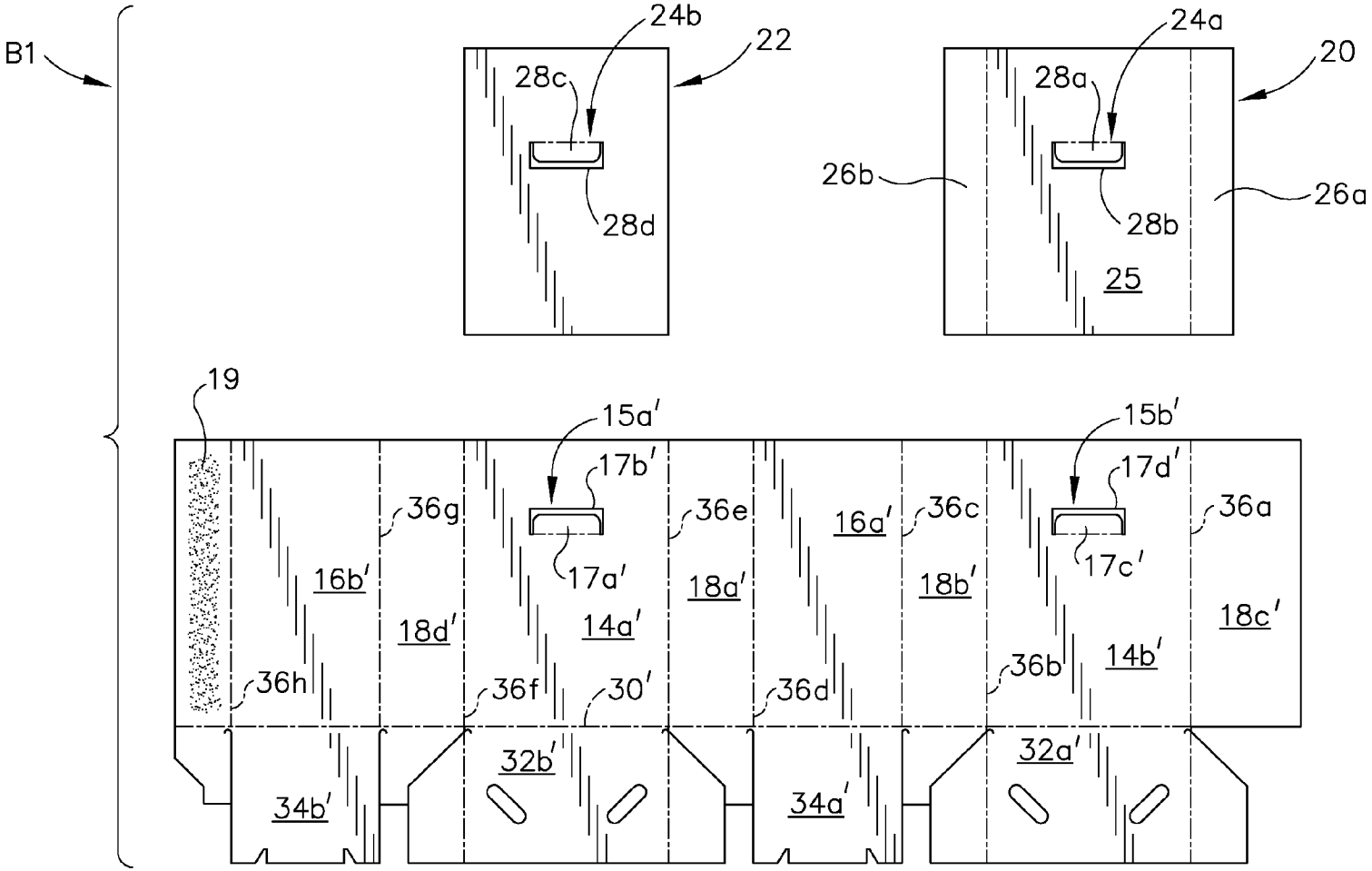
FIG. 5 is a plan view of a blank B1 for making the container having the two self-locking support panels in accordance to the first embodiment of the invention.

FIG. 5 is a plan view of a blank B1 for making the container 10 having a body 11 and two self-locking support panels 20 and 22 in accordance to the first embodiment of the invention. The blank B1 is substantially flat symmetrical with respect to its lateral axis thereof. The blank B1 is preferably an integral piece of a material such as continuous sheet of conventional corrugated cardboard. The blank B1 is cut along its outer margins to form its specific shape. The blank B1 includes a bottom wall panel 12' that is defined by four bottom flaps 32*a*', 32*b*', 34*a*', and 34*b*' that enclose the bottom of the container 10. The bottom wall panel 12' is formed by fold line 30. The opposite parallel side wall panels 14*a*', 14*b*', opposite parallel end wall panels 16*a*', 16*b*' and diagonal corner panels 18*a*', 18*b*, 18*c*, and 18*d* are formed with lateral fold lines 36*a*, 36*b*, 36*c*, 36*d*, 36*e*, 36*f*, 36*g*, and 36*h*.

The intersection of the longitudinal fold line 30' with the lateral fold lines 36*a*, 36*b*, 36*c*, 36*d*, 36*e*, 36*f*, 36*g*, and 36*h* define the boundary of the bottom wall panel 12' with the opposite parallel side wall panels 14*a*', 14*b*', opposite parallel end wall panels 16*a*', 16*b*' and diagonal corner panels 18*a*', 18*b*, 18*c*, and 18*d*. A glue flap 19 is foldably joined to the end wall panel 16*b*' so that in the operative position, the glue flap 19 is attached to the diagonal wall panel to enclose the side walls. Each of the side wall panels 14*a*', 14*b*' includes the first locking member 15*a*' comprises a first locking tab 17*a*' and a first U-shaped slot 17*b*'. The first U-shaped slot 17*b*' is formed by indentation of the first locking tab 17*a*' away from the side wall panel 14*a*'. Similarly, the second locking member 15*b*' includes a second locking tab 17*c*' and a second U-shaped slot 17*d*' which the second U-shaped slot 17*d*' is formed by indentation of the second locking tab 17*c*' away from the side wall panel 14*b*'. The first self-locking panel 20' is defined by a central panel 25' and two diagonal panels 26*a*', 26*b*' defined by fold lines 27*a*', 27*b*'. The respective first and second self-locking panels 20', 22' includes a respective third locking member 24*a*' and a fourth locking member 24*b*'.

Figure 6:
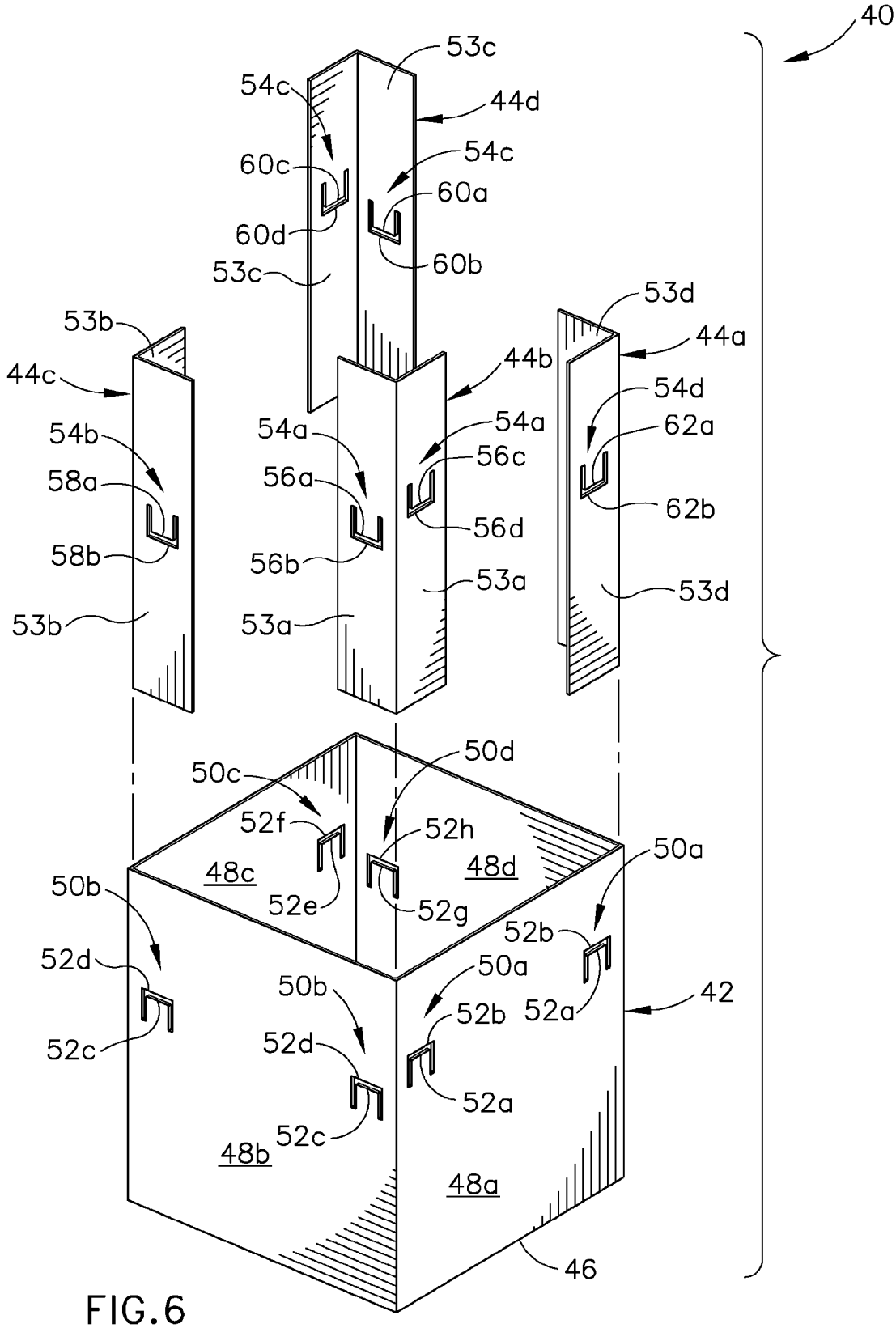
FIG. 6 is an exploded perspective view of a shipping container having four self-locking support panel posts in a spaced relationship in accordance to a second embodiment of the invention.

FIG. 6 is an exploded perspective view of a shipping container 40 having a body 42 and four self-locking support panel posts 44*a*, 44*b*, 44*c*, and 44*d* in a spaced relationship in accordance to a second embodiment of the invention. The body 42 comprises a bottom wall 46 and four parallel side walls 48*a*, 48*b*, 48*c*, and 48*d* foldably joined with one another. Each of the respective side walls 48*a*, 48*b*, 48*c*, and 48*d* includes a pair of respective first locking members 50*a*, 50*b*, 50*c*, and 50*d* that are formed near side edge and above the central portion of each side wall and they are substantially the same shape. Each of the first pair of locking member 50*b*, 50*c*, and 50*d* includes respective a first locking tab 52*c* and a first U-shaped slot 52*d*, a first locking tab 52*e* and a first U-shaped slot 52*f*, a first locking tab 52*g* and a first U-shaped slot 52*h*. Each of the respective self-locking support panel posts 44*a*, 44*b*, 44*c*, and 44*d* is defined by a respective pair of panels 53*a*, 53*b*, 53*c*, and 53*d* foldably joined to one another. The respective pair of panels 53*a*, 53*b*, 53*c*, and 53*d* is identical to one another.

Figure 7:
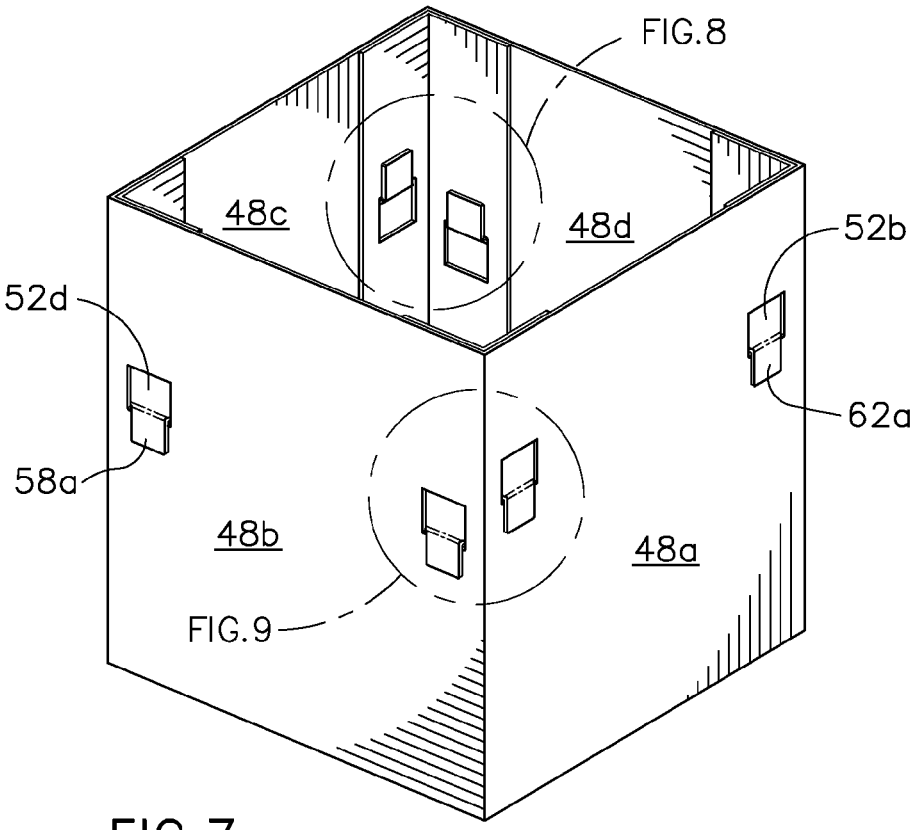
FIG. 7 is a perspective view of the shipping container shown in FIG. 6 with the four self-locking support panel posts in an operative position inside the container.
Figure 8:
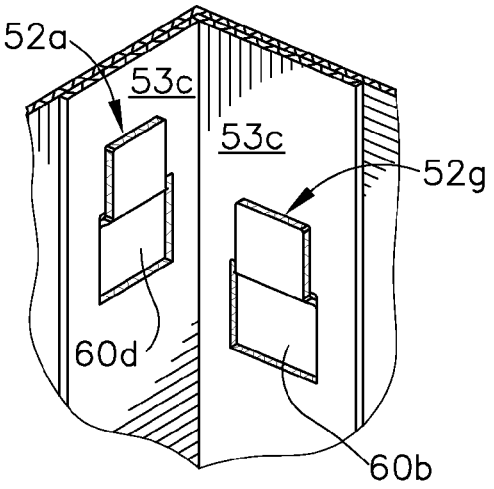
FIGS. 8 and 9 are fragmentary perspective views of the container in FIG. 6 illustrating the locking engagement of each of the self-locking support panel posts with the container.
Figure 9:
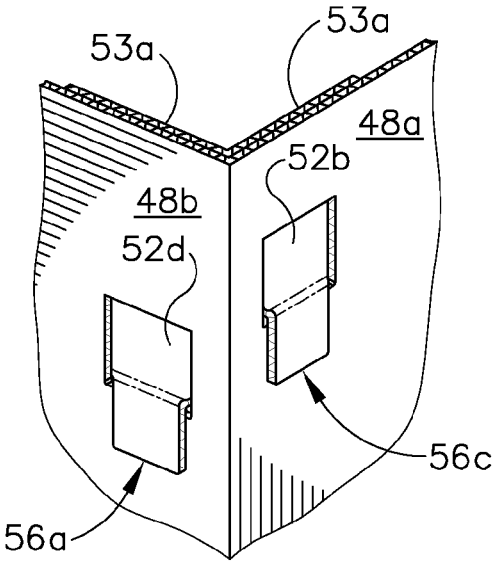

Each of the respective self-locking support panel posts 44*a*, 44*b*, 44*c*, and 44*d* includes a respective pair of second locking member 54*a*, 54*b*, 54*c*, and 54*d* that are formed near side edge and above the central portion of each self-locking support panel posts and they are substantially the same shape. These second locking members 54*a*, 54*b*, 54*c*, and 54*d* are generally the same as the first embodiment of the invention as having a locking tab and a U-shaped slot that are engaged with the corresponding first locking members 50*a*, 50*b*, 50*c*, and 50*d* to significantly enhance the strength and rigidity of the container 40 as depicted in FIG. 7. For example, self-locking support panel post 44*b* has a pair of locking tab and a U-shaped slot 54*a* that each of which is formed on respective panels 53*a*. The respective self-locking support panel posts 44*b* and 44*d* are inserted into the corresponding corners of the body 42 as seen best in FIGS. 7, 8, and 9. The FIGS. 8 and 9 are fragmentary perspective views of the container 40 in FIG. 6 illustrating the locking engagement of each of the self-locking support panel posts 44*a*, 44*b*, 44*c*, and 44*d* with the body 42.

Figure 10:
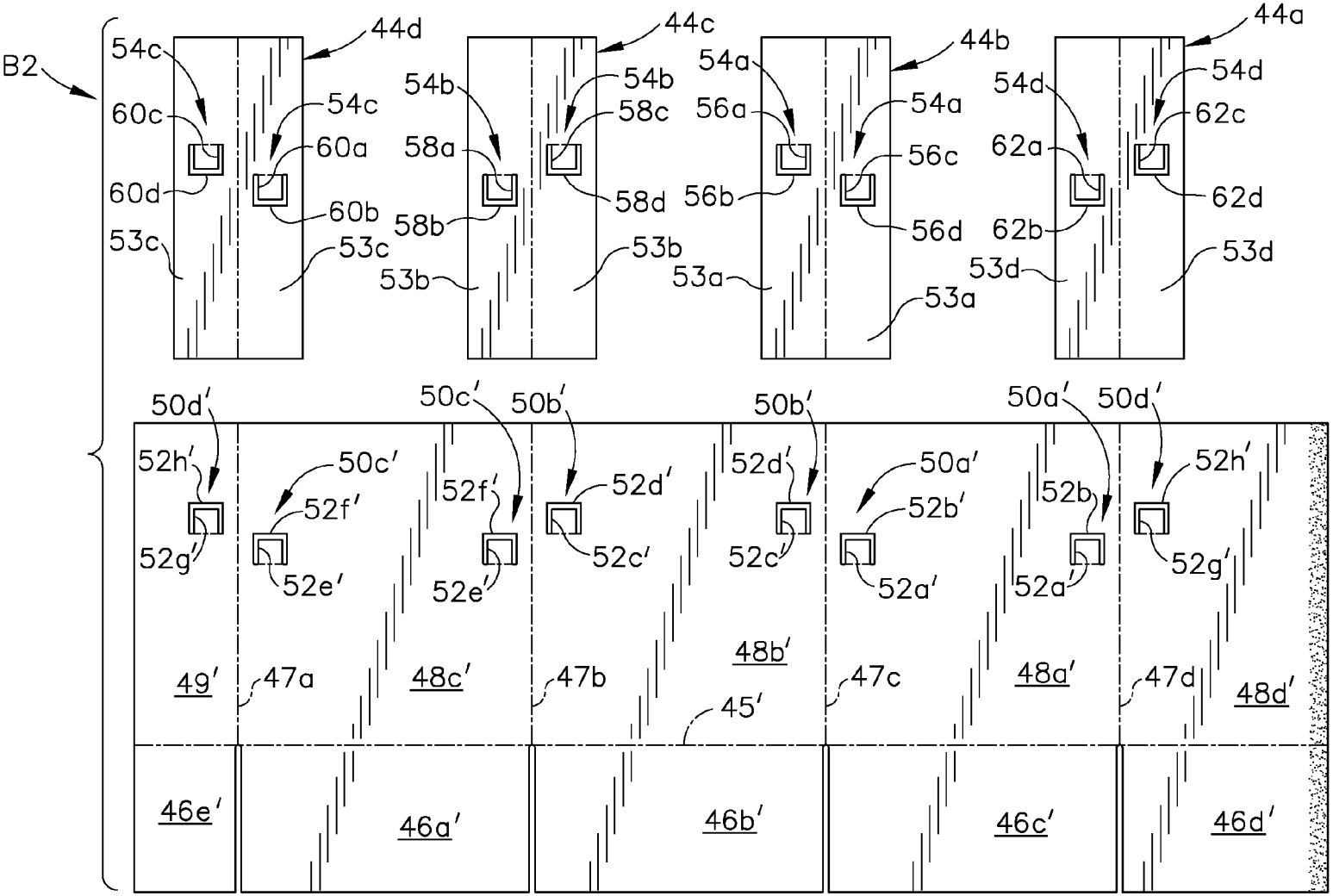
FIG. 10 is a plan view of a blank B2 for making a container having the four self-locking support panel posts in accordance to the second embodiment of the invention.

FIG. 10 is a plan view of a blank B2 for making a container 40' having a body 42' and four self-locking support panel posts 44*a*', 44*b*', 44*c*', and 44*d*' in accordance to the second embodiment of the invention. The blank B2 is substantially flat symmetrical with respect to its lateral axis thereof. The blank B2 is preferably an integral piece of a material such as continuous sheet of conventional corrugated cardboard. The blank B2 is cut along its outer margins to form its specific shape. The blank B2 includes a bottom wall panel 46' that is defined by four bottom flaps 46*a*, 46*b*, 46*c*, 46*d* and 46*e* that enclose the bottom of the container 40. The bottom wall flaps are formed by fold line 45. The opposite parallel side wall panels 48*a*', 48*b*', 48*c*', 48*d* are formed with lateral fold lines 47*a*, 47*b*, 47*c*, and 47*d*. The intersection of the longitudinal fold line 45 with the lateral fold lines 47*a*, 47*b*, 47*c*, and 47*d* define the boundary of the bottom wall panel 46' with the opposite parallel side wall panels 14*a*', 14*b*', opposite parallel end wall panels 16*a*', 16*b*' and diagonal corner panels 18*a*', 18*b*, 18*c*, and 18*d*. A glue flap 49 is foldably joined to the side wall panel 48*c*' so that, in folding position, the glue flap 49 is attached to the side wall panel 48*d*' to enclose the side walls. The locking members and self-locking support panel posts are discussed hereinabove and will not be discussed again to avoid redundancy.

Figure 11:
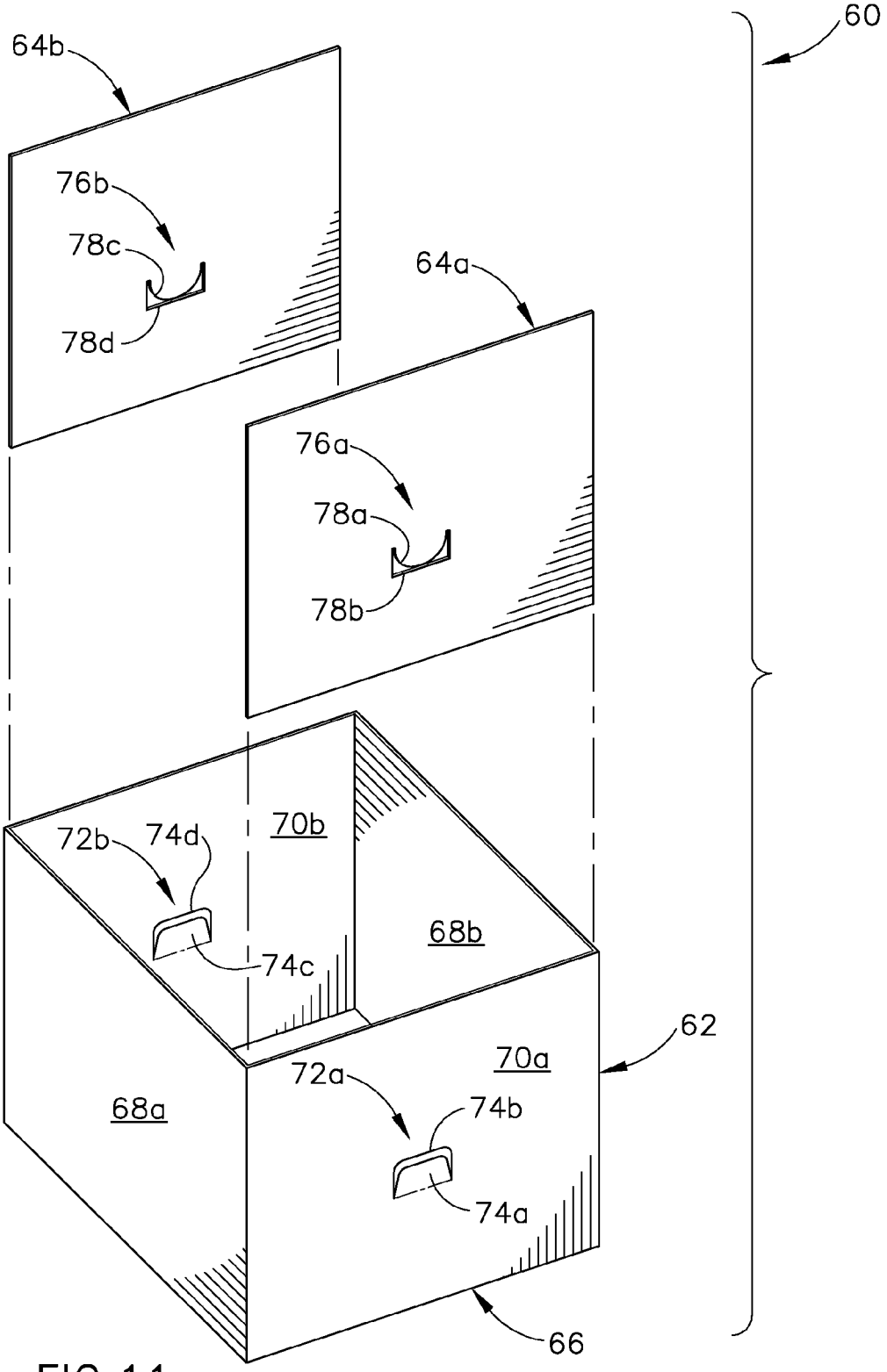
FIG. 11 is an exploded perspective view of a shipping container having two self-locking support panels in a spaced relationship in accordance to a third embodiment of the invention.

FIG. 11 is an exploded perspective view of a shipping container 60 having a body 62 and two self-locking support panels 64*a*, 64*b* in a spaced relationship in accordance to a third embodiment of the invention. The body 62 comprises a bottom wall 66, opposite parallel side walls 68*a*, 68*b*, opposite parallel end walls 70*a*, 70*b* which are foldably joined to one another. Each of the respective end walls 70*a*, 70*b* includes a respective first and second locking members 72*a* and 72*b* that are formed thereto proximately on the central portion and they are substantially the same shape. The first locking member 72*a* includes a first locking tab 74*a* and a first U-shaped slot 74*b*. The first U-shaped slot 74*b* is formed by indentation of the first locking tab 74*a* toward the interior of the body 62. Similarly, the second locking member 72*b* includes a second locking tab 74*c* and a second U-shaped slot 74*d* which the second U-shaped slot 74*d* is formed by indentation of the second locking tab 74*c* toward the interior of the body 62.

Figure 12:
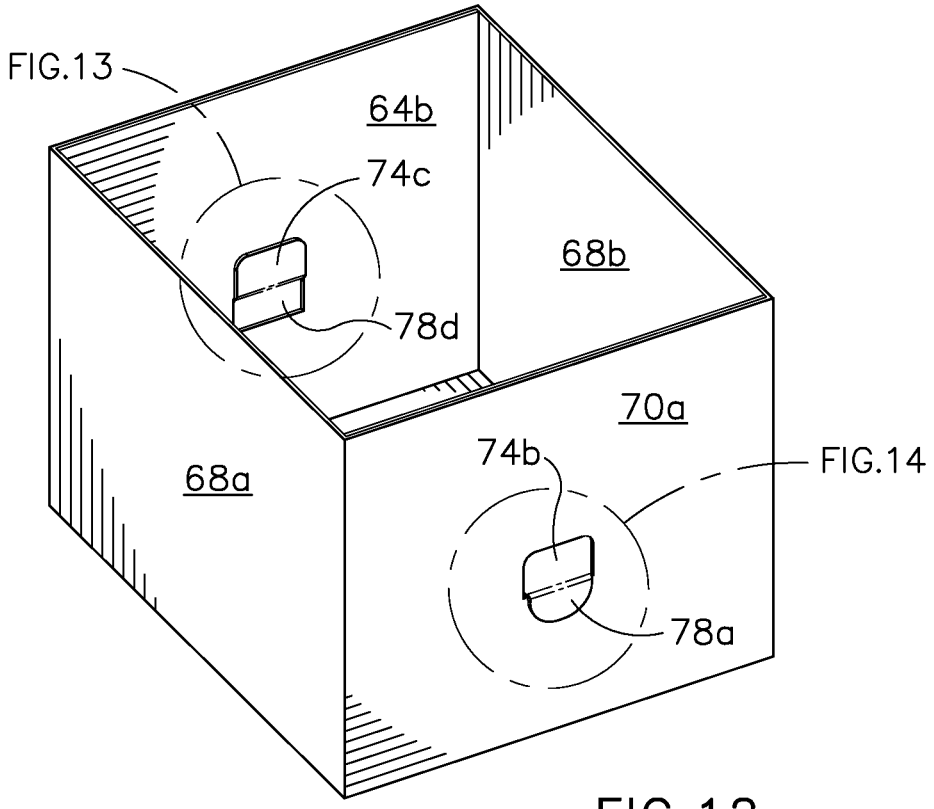
FIG. 12 is a perspective view of the shipping container shown in FIG. 11 with the two self-locking support panels in an operative position inside the container.
Figure 13:
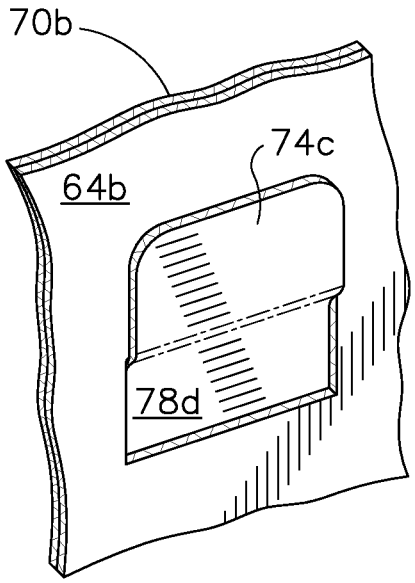
FIGS. 13 and 14 are fragmentary perspective views of the container in FIG. 12 illustrating the locking engagement of each of the self-locking support panels with the container.
Figure 14:
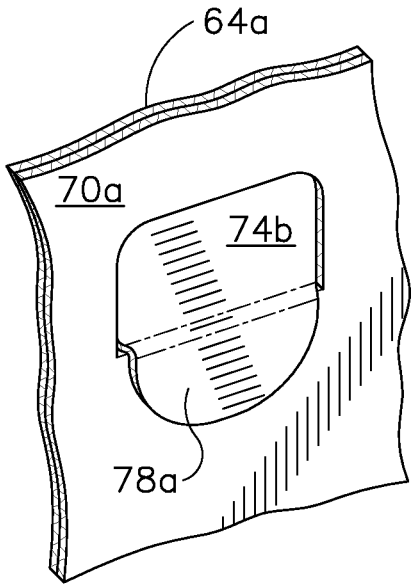

The two self-locking panels are defined by a first self-locking panel 64*a* and a second self-locking panel 64*b*. Each of the respective first and second self-locking panels 64*a*, 64*b* includes a respective third locking member 76*a* and a fourth locking member 76*b*. The third locking member 76*a* includes a third locking tab 78*a* and a third U-shaped slot 78*b*. The third U-shaped slot 78*b* is formed by indentation of the third locking tab 78*a* outward away from the self-locking panel 64*b* when it is engaged. Similarly, the fourth locking member 76*b* includes a fourth locking tab 78*c* and a fourth U-shaped slot 78*d* which the fourth U-shaped slot 78*d* is formed by indentation of the fourth locking tab 78*c* away from the self-locking panel 76*b* when it is engaged. The first and second locking members 72*a*, 72*b*, the third and fourth locking member 76*a*, 76*b* are substantially the same with one another. When the first and second self-locking panels 64*a*, 64*b* are inserted into the inner sides of the respective end walls 70*a*, 70*b*, the respective first and second locking member 72*a*, 72*b* receives the corresponding third locking member 76*a* and a fourth locking member 76*b* such that the second locking tab 74*c* is engaged with the third U-shaped slot 78*d* and the fourth locking tab 78*a* is engaged with the first U-shaped slot 74*b* as seen best in FIGS. 12, 13, and 14. FIGS. 13 and 14 are fragmentary perspective views of the container in FIG. 12 illustrating the locking engagement of each of the self-locking support panels with the container.

Figure 15:
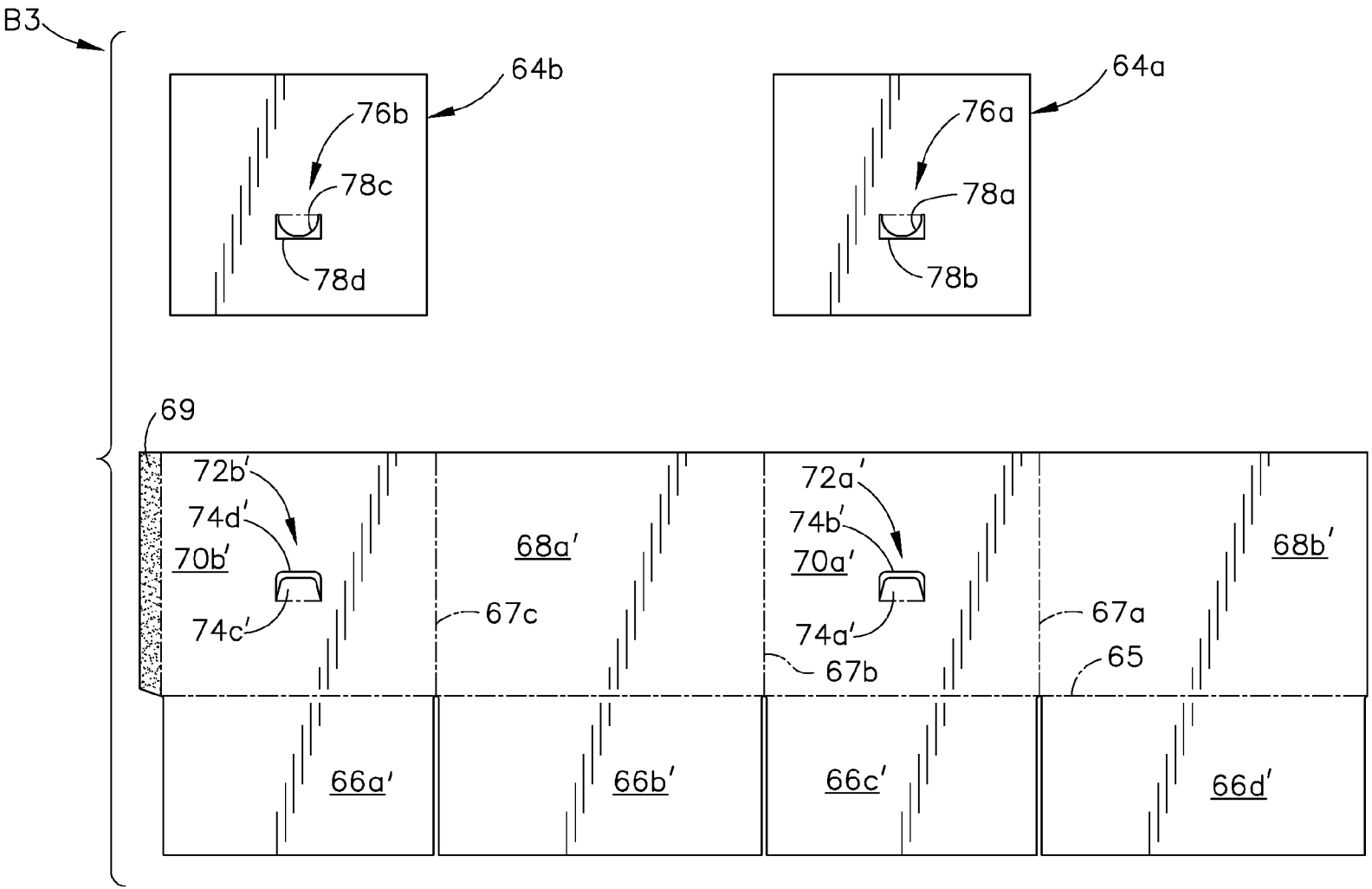
FIG. 15 is a plan view of a blank B3 for making the container having the two self-locking support panels in accordance to the third embodiment of the invention.

FIG. 15 is a plan view of a blank B3 for making the shipping container 60 having the two self-locking support panels 64*a*, 64*b* in accordance to the third embodiment of the invention. The blank B3 is substantially flat symmetrical with respect to its lateral axis thereof. The blank B3 is preferably an integral piece of a material such as continuous sheet of conventional corrugated cardboard. The blank B3 is cut along its outer margins to form its specific shape. The blank B3 includes a bottom wall panel 66' that is defined by four bottom wall flaps 66*a*, 66*b*, 66*c*, and 66*d* that enclose the bottom of the container 60. The bottom wall flaps 66*a*, 66*b*, 66*c*, and 66*d* are formed by fold line 65. The opposite parallel side wall panels 68*a*', 68*b*' and end wall panels 70*a*', 70*b*' are formed by respective lateral fold lines 67*a*, 67*b*, and 67*c*. The intersection of the longitudinal fold line 65 with the lateral fold lines 67*a*, 67*b*, and 67*c* define the boundary of the bottom wall panel 66' with the side wall panels 68*a*', 68*b*' and end wall panels 70*a*', 70*b*'. A glue flap 69 is foldably joined to the end wall panel 70*b*' so that, in folding position, the glue flap 69 is attached to the side wall panel 68*b*' to enclose the body 62. The first and second locking members 72*a* and 72*b* and the two self-locking support panels 64*a*, 64*b* are discussed hereinabove and will not be discussed again to avoid redundancy.

Figure 16:
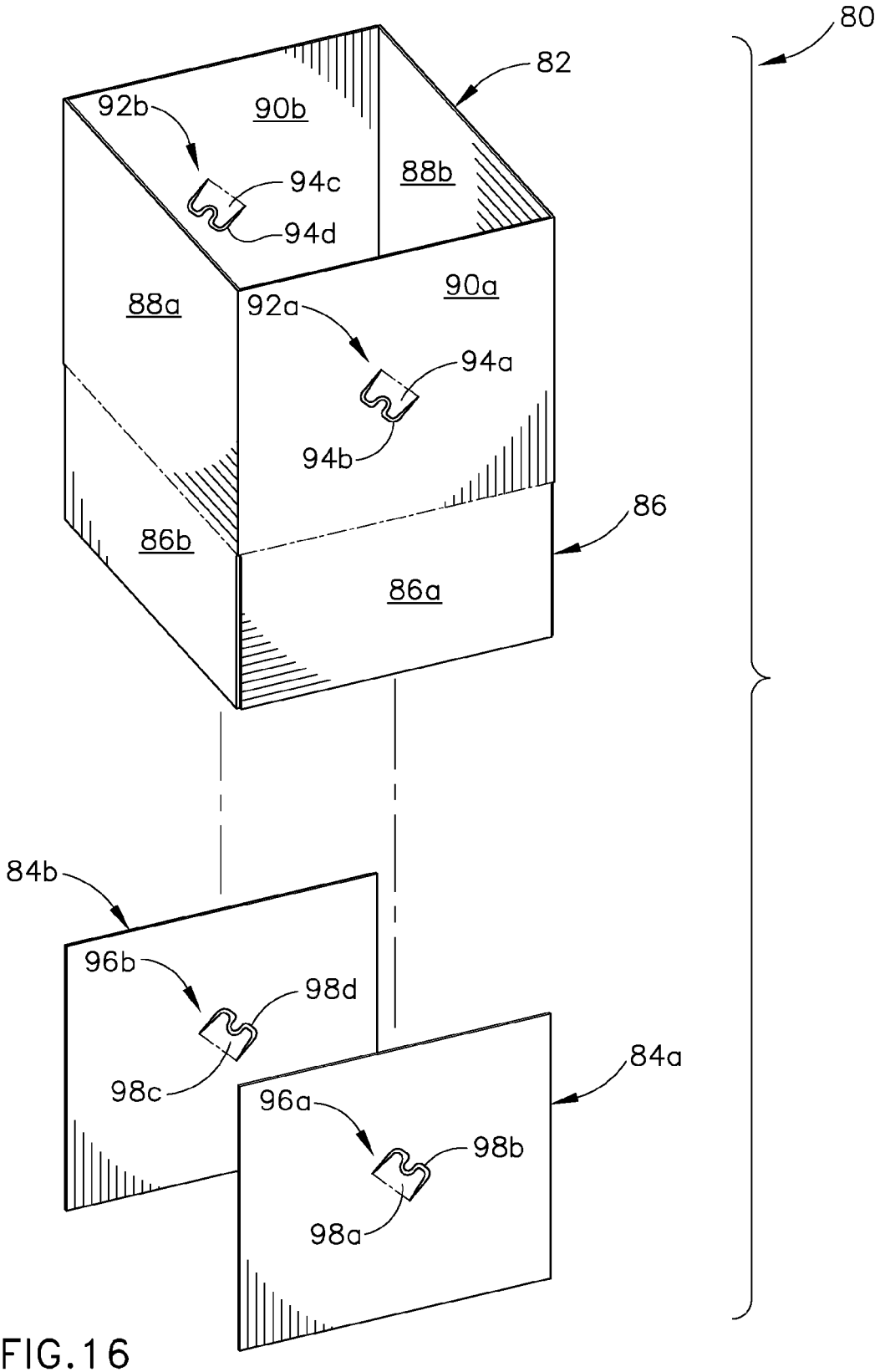
FIG. 16 is an exploded perspective view of a shipping container having two self-locking support panels in a spaced relationship in accordance to a fourth embodiment of the invention.

FIG. 16 is an exploded perspective view of a shipping container having a body 82 and two self-locking support panels 84*a*, 84*b* in a spaced relationship in accordance to a fourth embodiment of the invention. The body 82 comprises a bottom wall 86, opposite parallel side walls 88*a*, 88*b*, opposite parallel end walls 90*a*, 90*b* which are foldably joined to one another. Each of the respective end walls 90*a*, 90*b* includes a respective first and second locking members 92*a* and 92*b* that are formed thereto proximately on the central portion and they are substantially the same shape. The first and second locking members 92*a* and 92*b* are formed in angled orientation with respect to the respective end walls 90*a*, 90*b* so that it prohibits the products in the container to move or unlock the locking members 92*a* and 92*b* from the body 82. The first locking member 92*a* includes a first locking tab 94*a* and a first B-shaped slot 94*b*. The first B-shaped slot 94*b* is formed by indentation of the first locking tab 94*a* toward the interior of the body 82. Similarly, the second locking member 92*b* includes a second locking tab 94*c* and a second B-shaped slot 94*d* which the second B-shaped slot 94*d* is formed by indentation of the second locking tab 94*c* toward the interior of the body 82. The two self-locking panels are defined by a first self-locking panel 84*a* and a second self-locking panel 84*b*. Each of the respective first and second self-locking panels 84*a*, 84*b* includes a respective third locking member 96*a* and a fourth locking member 96*b*. The third locking member 96*a* includes a third locking tab 98*a* and a third B-shaped slot 98*b*. The third B-shaped slot 98*b* is formed by indentation of the third locking tab 98*a* outward away from the self-locking panel 84*a* when it is engaged.

Figure 17:
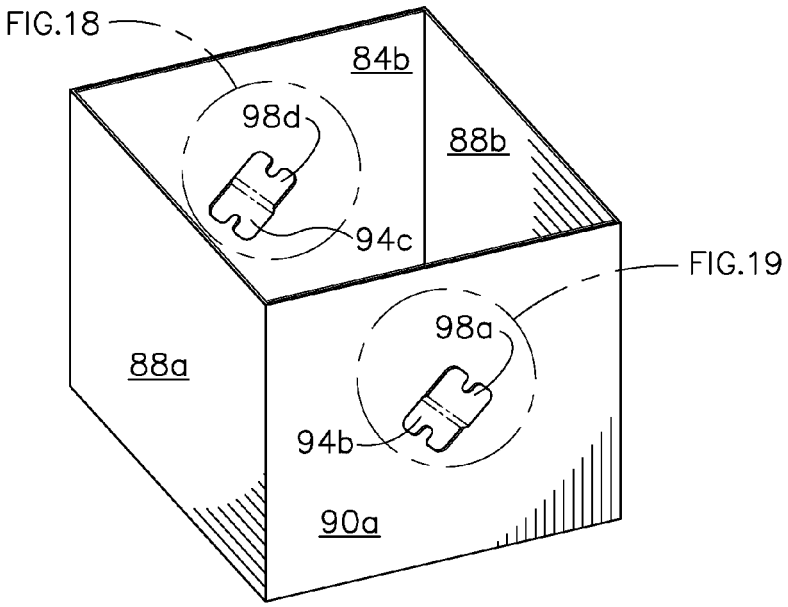
FIG. 17 is a perspective view of the shipping container shown in FIG. 16 with the two self-locking support panels in an operative position inside the container.
Figure 18:
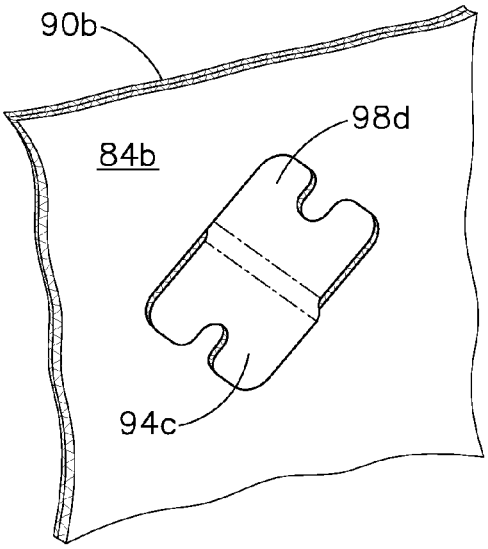
FIGS. 18 and 19 are fragmentary perspective views of the container in FIG. 17 illustrating the locking engagement of each of the self-locking support panels with the container.
Figure 19:
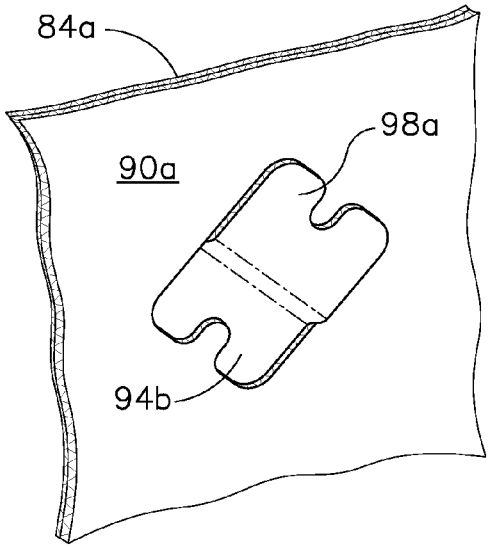

Similarly, the fourth locking member 96*b* includes a fourth B-shaped locking tab 98*c* and a fourth B-shaped slot 98*d* which the fourth B-shaped slot 98*d* is formed by indentation of the fourth locking tab 98*c* away from the self-locking panel 84*b* when it is engaged. The first and second locking members 94*a*, 94*b*, the third and fourth locking member 96*a*, 96*b* are substantially the same with one another. When the first and second self-locking panels 84*a*, 84*b* are inserted into the inner sides of the respective end walls 90*a*, 90*b* via bottom of the body 82, the respective first and second locking member 92*a*, 92*b* receives the corresponding third locking member 96*a* and a fourth locking member 96*b* such that the second locking tab 94*c* is engaged with the third U-shaped slot 98*d* and the fourth locking tab 98*a* is engaged with the first B-shaped slot 94*b* as seen best in FIGS. 17, 18, and 19. FIGS. 18 and 19 are fragmentary perspective views of the container 80 in FIG. 17 illustrating the locking engagement of each of the self-locking support panels 84*a*, 84*b* with the body 82.

Figure 20:
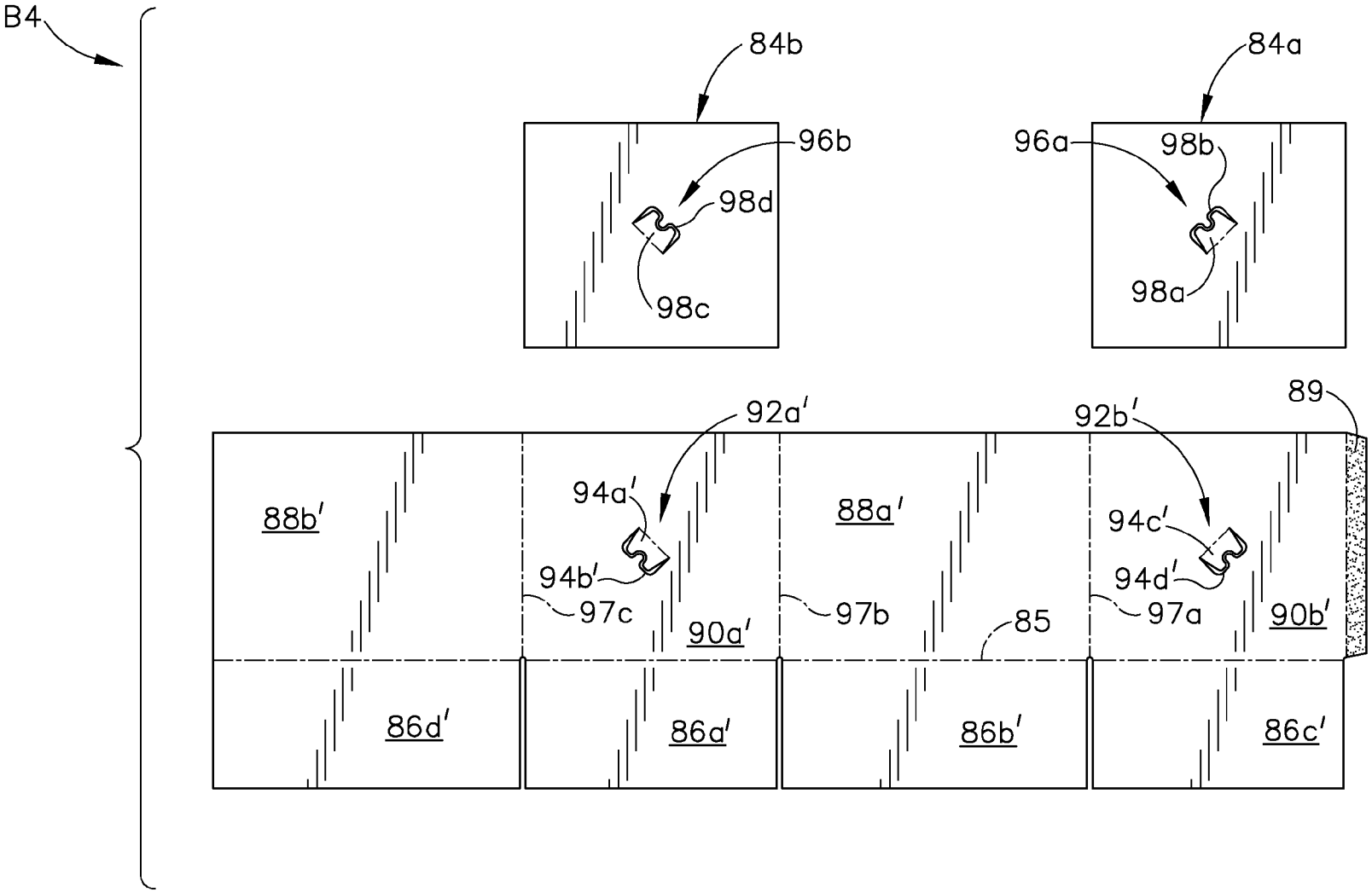
FIG. 20 is a plan view of a blank B4 for making the container having the two self-locking support panels in accordance to the fourth embodiment of the invention.

FIG. 20 is a plan view of a blank B4 for making the container having the two self-locking support panels in accordance to the fourth embodiment of the invention. The blank B3 is substantially flat symmetrical with respect to its lateral axis thereof. The blank B4 is preferably an integral piece of a material such as continuous sheet of conventional corrugated cardboard. The blank B4 is cut along its outer margins to form its specific shape. The blank B4 includes a bottom wall panel 86' that is defined by four bottom wall flaps 86*a*, 86*b*, 86*c*, and 86*d* that enclose the bottom of the container 80. The bottom wall flaps 86*a*, 86*b*, 86*c*, and 86*d* are formed by fold line 85. The opposite parallel side wall panels 88*a*', 88*b*' and end wall panels 90*a*', 90*b*' are formed by respective lateral fold lines 97*a*, 97*b*, and 97*c*. The intersection of the longitudinal fold line 95 with the lateral fold lines 97*a*, 97*b*, and 97*c* define the boundary of the bottom wall panel 86' with the side wall panels 88*a*', 88*b*' and end wall panels 90*a*', 90*b*'. A glue flap 89 is foldably joined to the end wall panel 90*b*' so that, in folding position, the glue flap 69 is attached to the side wall panel 88*b*' to enclose the body 82. The first and second locking members 92*a* and 92*b* and the two self-locking support panels 84*a*, 84*b* are discussed hereinabove and will not be discussed again to avoid redundancy.

Figure 21:
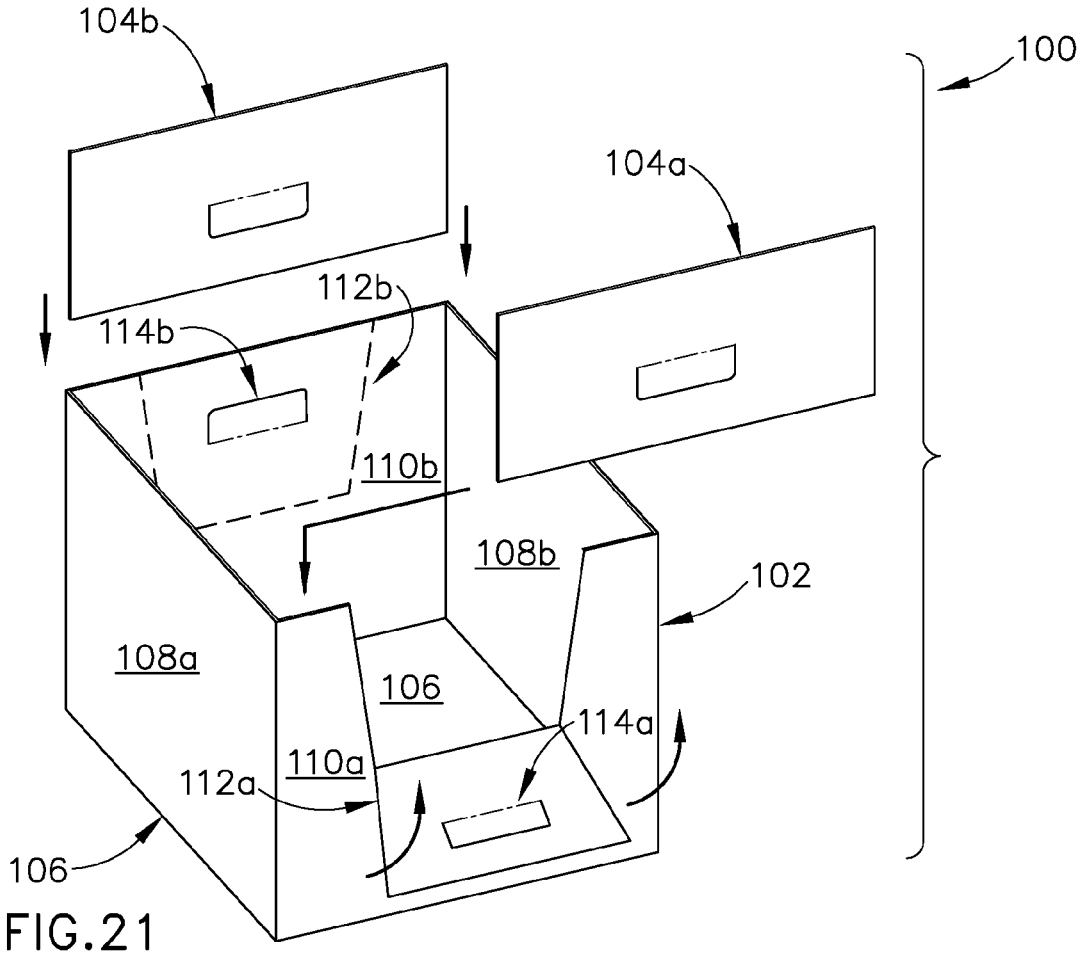
FIG. 21 is an exploded perspective view of a shipping container 100 having a body 102 two self-locking support panels 104*a*, 104*b* in a spaced relationship in accordance to a fifth embodiment of the invention.
Figure 22:
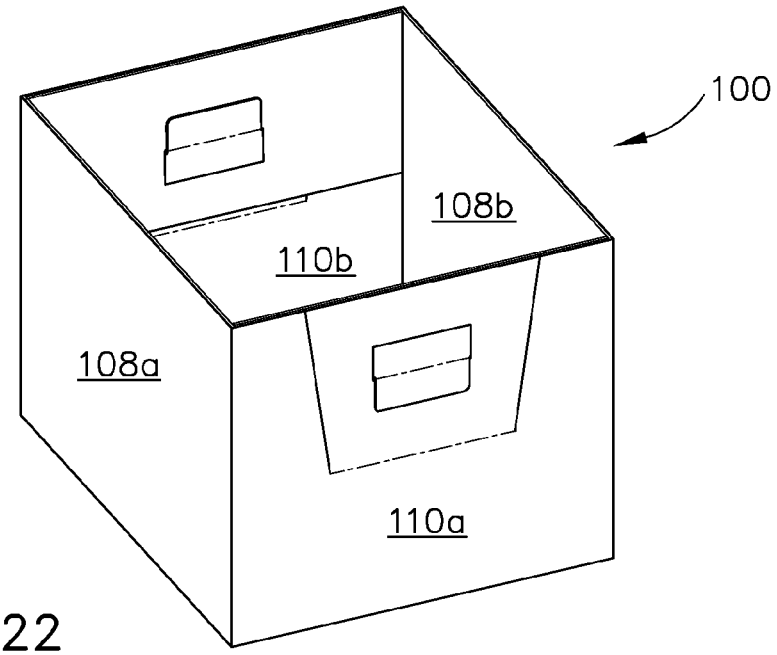
FIG. 22 is a perspective view of the shipping container shown in FIG. 21 with the two self-locking support panels in an operative position within the container.

FIG. 21 is an exploded perspective view of a shipping container 100 having a body 102 two self-locking support panels 104*a*, 104*b* in a spaced relationship in accordance to a fifth embodiment of the invention. The body 102 comprises a bottom wall 106, opposite parallel side walls 108*a*, 108*b*, opposite parallel end walls 110*a*, 110*b* foldably joined to one another. The container 100 includes a vertically-oriented body 102 that is adapted to receive multiple products. The container 100 has a height dimension that is greater than its width and depth dimensions. The container 100 preferably has dimensions that permit the container to pass through a standard office doorway (e.g., a 36 inch wide doorway). Accordingly, the container 100 can be delivered to a location within an office environment, if desired. The container 100 is constructed of a lightweight but relatively durable material such as corrugated cardboard. Each of the end walls 110*a*, 110*b* includes respective access panels 112*a*, 112*b* that provides access to the interior of the container 100. The access panel 112*a*, 112*b* opens outward and downward from the top of the container 100 toward the bottom of the container. The access panel 112 can be formed, for instance, by cutting the end walls 110*a*, 110*b* from the top of the container 100 along two cut lines to approximately the middle of the container, and scoring the respective end walls 110*a*, 110*b* from the bottom of one cut line to the bottom of the other cut line. Each of the respective end walls 110*a* 110*b* includes a respective first and second locking members 114*a* and 114*b* that are formed thereto above the central portion and they are substantially the same shape. The a respective first and second locking members 114*a* and 114*b* receive therein the respective self-locking support panels 104*a*, 104*b* to self locks into the respective access panels securing the access panels in its closed position. The self-locking support panels 104*a*, 104*b* extend across the entire width of the end wall panel and from the top to at least the bottom of the access panel for added bulge resistance with minimum material cost.

While the invention has been described with reference to a number of preferred embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A container comprising:

a body having a bottom wall, opposed side walls, and opposed end walls foldably joined with one another for holding and shipping different products contained therein wherein each of the opposed side walls includes respective first and second locking members that are formed thereto; and at least one separate self-locking support panel configured to be engaged with one of the opposed side walls or the opposed end walls in an overlapping relationship wherein each of the first and second locking members is defined by a first B-shaped locking tab and a first B-shaped slot wherein the first B-shaped slot is formed by indentation of the first locking tab toward interior of the body.

2. The container of claim 1 wherein the at least one self-locking support panel includes two self-locking support panels each of which is attached to the corresponding opposed side walls or opposed end walls.

3. The container of claim 2 wherein each of the respective separate self-locking support panels includes third and fourth locking members that are engaged with the first and second locking members.

4. The container of claim 3 wherein each of the third and fourth locking members is defined by a third locking tab and a fourth slot.

* * * * *